US006186935B1

(12) United States Patent
Wiholm

(10) Patent No.: US 6,186,935 B1
(45) Date of Patent: Feb. 13, 2001

(54) METHOD AND APPARATUS FOR PRODUCING FOLDERS

(75) Inventor: Sture Wiholm, Johanneshov (SE)

(73) Assignee: Bindomatic AB, Stockholm (SE)

( * ) Notice: Under 35 U.S.C. 154(b), the term of this patent shall be extended for 0 days.

(21) Appl. No.: 08/840,420

(22) Filed: Apr. 29, 1997

Related U.S. Application Data

(63) Continuation of application No. 08/397,215, filed as application No. PCT/SE92/00618 on Sep. 8, 1992, now abandoned.

(51) Int. Cl.[7] ..... B42C 7/00

(52) U.S. Cl. ..... 493/331; 493/332; 493/399; 493/947; 412/8; 281/36

(58) Field of Search ..... 493/328–334, 493/397, 398, 399, 400, 401, 402, 403, 405, 416, 417, 449, 947; 412/4, 5, 8; 281/29, 36

(56) References Cited

U.S. PATENT DOCUMENTS

| | | | | |
|---|---|---|---|---|
| 4,111,460 | * | 9/1978 | Roberts | 281/29 |
| 4,156,538 | * | 5/1979 | Roberts | 281/29 |
| 4,289,330 | * | 9/1981 | Wiermanski | 281/21 R |
| 4,505,629 | * | 3/1985 | Lynch | 412/5 |
| 4,898,405 | * | 2/1990 | Pickering | 281/29 |
| 4,928,995 | * | 5/1990 | Pickering | 281/29 |
| 5,062,754 | * | 11/1991 | Bolin | 412/4 |
| 5,078,563 | * | 1/1992 | Lolli | 412/8 |
| 5,120,176 | * | 6/1992 | Bhatia | 412/8 |
| 5,203,590 | * | 4/1993 | Ranson | 281/21.1 |

FOREIGN PATENT DOCUMENTS

| | | |
|---|---|---|
| 3811133 | 9/1989 | (DE) . |
| 2072096 | 9/1981 | (GB) . |
| 2186526 | 8/1987 | (GB) . |
| 2197256 | 5/1988 | (GB) . |
| 452287 | 11/1987 | (SE) . |

* cited by examiner

*Primary Examiner*—Joseph J. Hail, III
*Assistant Examiner*—Christopher W. Day
(74) *Attorney, Agent, or Firm*—Cooper & Dunham LLP

(57) ABSTRACT

A method and an apparatus for producing folders of the kind comprising two cover sheets, a spine, which is connected with the cover sheets by means of creasing lines, and a binding agent, which is applied to the inside of the spine and which is activable to connect sheets inserted between the cover sheets to the spine. The binding agent is applied to the spine and to the cover sheets while the cover sheets are essentially parallel to each other and perpendicular to the spine.

16 Claims, 4 Drawing Sheets

(A)

(B)

(C)

(D)

(E)

(F)

METHOD AND APPARATUS FOR PRODUCING FOLDERS

This is a continuation of application Ser. No. 08/397,215 filed Mar. 8, 1995, now abandoned, which is a 371 of PCT/SE92/00618, filed Sep. 8, 1992.

TECHNICAL FIELD

The present invention relates to a method and an apparatus for producing folders of the kind comprising two cover sheets, a spine, which is connected with the cover sheets by means of creasing lines, and a binding agent, which is applied to the inside of the spine and which is activable to connect sheets inserted between the cover sheets to the spine.

Folders of this kind have been widely used, especially folders using hot-melt glue as the binding agent. On insertion of a stack of sheets in the folder into contact with the hot-melt glue in the spine of the folder, the folder with contents is placed in a so called binding machine, in which the hot-melt glue is heated such that the stack of sheets will sink into the glue. After cooling, the stack of sheets is connected with the spine of the folder.

PRIOR ART

There are previously known a variety of methods and devices for manufacturing folders of the above described type.

A common method is attaching a solid strip of glue to a flat folder blank, which will then be folded along creasing lines on either side of the strip of glue to define a finished folder. Attachment of the strip of glue and forming of the creasing lines may be carried out, for example, in the way disclosed in the Swedish patent application as published for opposition 413 647, and the subsequent folding may take place, for example, in the way described in the Swedish patent application as published for opposition 431 975.

These known methods provide folders of high quality, however, it is necessary to use two different machines, increasing the costs of manufacture. Further, the side edges of the strip of glue will not adhere to the cover sheets in the finished folder, which under certain circumstances may cause sheets located on the outside in a stack of sheets to be situated between the strip of glue and the cover sheets in the subsequent binding process, so that said sheets will not adhere to the spine of the folder.

Another known method comprises the steps of forming creasing lines on a flat folder blank, or on a web of material, from which folder blanks will then be separated, and immediately thereafter spraying hot-melt glue between said creasing lines. A method like this is disclosed, for example, in the German Offenlegungsschrift 2 611 242.

The major disadvantages of the latter method is that the folder blank must be folded in a subsequent folding operation, that the strip of glue will be uneven and will partly cover the creasing lines, and that the side edges of the strip of glue will not adhere to the cover sheets of the finished folder.

In order to solve the problem of the side edges of the strip of glue not abutting against the cover sheets of the finished folder, a variety of solutions have been proposed.

A solution of this kind is disclosed in the U.S. Pat. No. 4,289,330 showing that special strips of glue are attached in the area of connection between the cover sheets and the folder spine provided with a strip of glue. Manufacture of a folder of this kind is complicated and expensive and is difficult to carry out automatically.

Another solution, evident from the U.S. Pat. No. 4,129,471, comprises the spraying of melted glue onto a flat folder blank, whereupon the blank is folded in order to define two cover sheets and a spine. Folding is carried out along lines located in the glue area. The major disadvantages of this solution is that folding is difficult to carry out and that the folding edges will be irregular and unsharp.

SUMMARY OF THE INVENTION

It is an object of the present invention to eliminate, at least partly, the disadvantages of previously known methods and devices of the above kind and to provide a method and an apparatus making it possible to produce high-quality folders at high speed.

This object is fulfilled in that the invention is provided with the features stated in the characterizing portions of the claims.

PREFERRED EMBODIMENT

Figure 1:
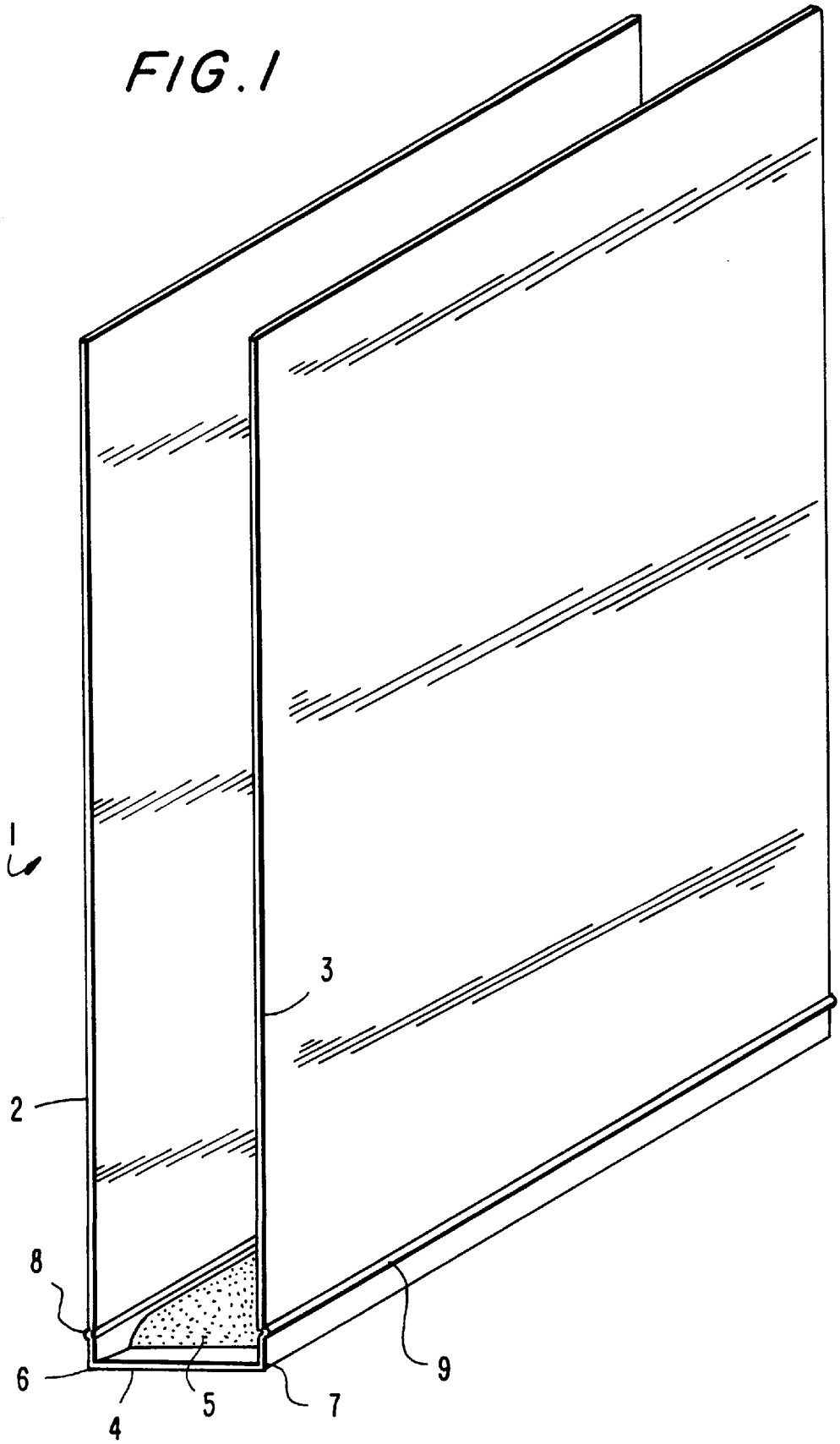
FIG. 1 is a perspective view showing a folder made by means of the method and the apparatus according to the present invention.

FIG. 1 shows a finished folder 1 made in accordance with the invention, which folder consists of two cover sheets 2 and 3, a spine 4 and a strip of glue 5. The cover sheets 2 and 3 are shown in FIG. 1 as parts of a single folder blank of cardboard or plastic but may consist of, for example, a front cover sheet of transparent plastic, which near the spine 4 is attached to a flap of the remaining part of the folder made of cardboard. Creasing lines 6 and 7 are formed in the area between the spine 4 and the cover sheets 2 and 3. Creasing lines 8 and 9 are also formed in the cover sheets 2 and 3 at a short distance from the spine 4. The strip of glue 5, consisting of a thermoplastic so called hot-melt glue, is attached to the spine as well as to those portions of the cover sheets 2 and 3 which are located between the creasing lines 6 and 8, and 7 and 9, respectively.

The folder 1 is used as a cover for a stack of paper sheets to be connected to the spine 4 of the folder via the strip of glue 5. The way in which this prebinding, so called binding, is carried out does not form part of the present invention and will therefore not be described. However, for understanding of the way binding is carried out, reference is made to the U.S. Pat. No. 4,678,386.

Figure 2:
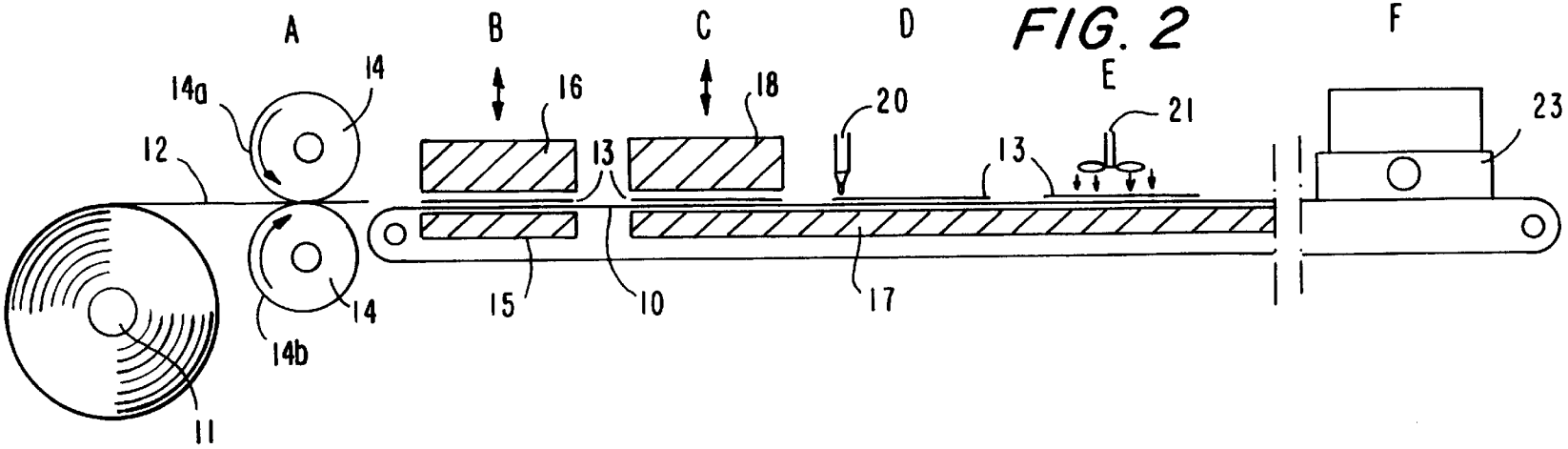
FIG. 2 is a diagrammatical side view, partly in section, of an apparatus for manufacturing folders according to FIG. 1.
Figure 3:
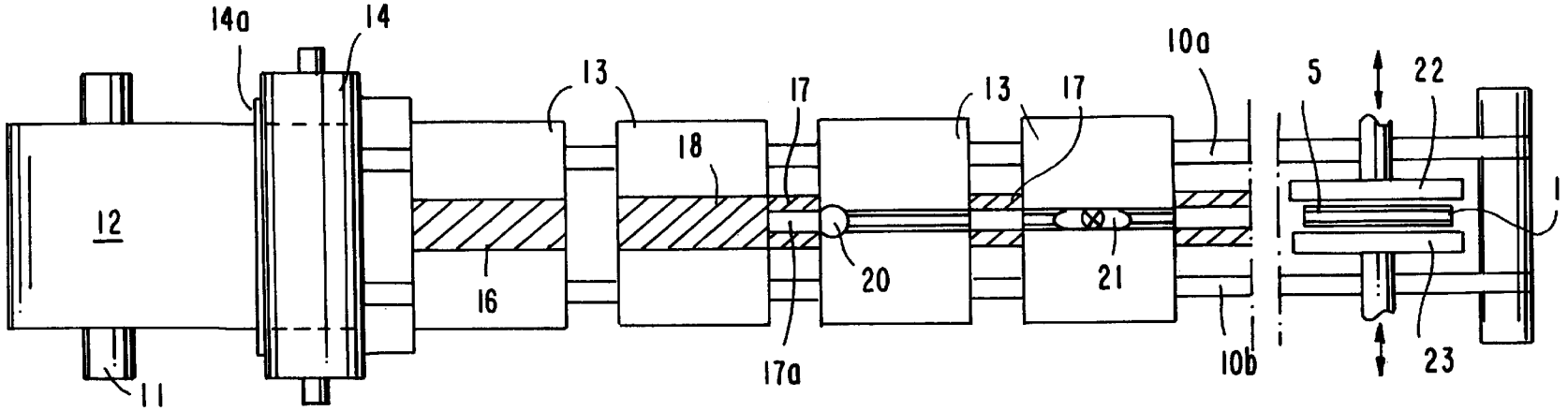
FIG. 3 is a view of the apparatus according to FIG. 2, seen from above.

FIGS. 2 and 3 show a conveyor 10, both upper parts 10*a* and 10*b* of which are moved step by step to the right in the figures. The speed of the conveyor 10 and the times for starting and stopping the same are synchronized with the various operations carried out at stations A–F.

A web of material 12 wound on a reel 11 is the starting material in the production of folders 1 at the stations A–F.

Figure 4:
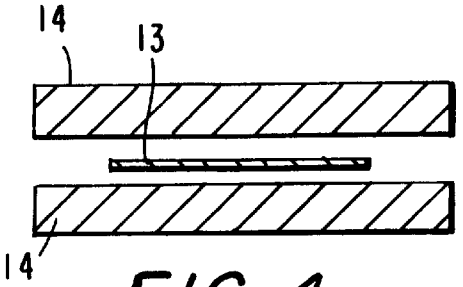
FIGS. 4–9 are cross-sectional views of stations being part of the apparatus according to FIGS. 2 and 3.
Figure 5:
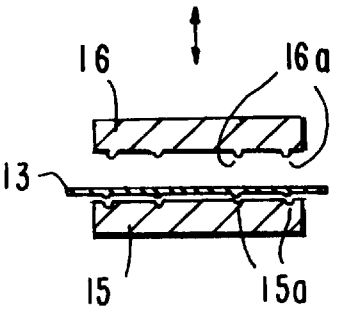

The web 12 is fed to the right in FIGS. 2 and 3 and is cut into folder blanks 13 at the station A (=FIG. 4) by rollers 14 provided with cutting edges 14*a* and cutting grooves 14*b*. Each folder blank 13 delivered from the station A is transferred to the conveyor 10 where it is held by non-illustrated means whilst being transported during the entire production procedure. The web 10 is stopped when the folder blank 13 is at the station B (=FIG. 5). At this station, the creasing lines 6–9 are formed in the folder blank 13 by creasing means including a fixed die 15 with elongated recesses 15*a* and an upwardly-downwardly movable punch 16 with elongated projections 16*a,* which are partly pressed into the recesses 15*a,* thereby forming the creasing lines.

After creasing and activation of the conveyor 10, the folder blank 13 will arrive at the station C (=FIG. 6) where the conveyor will be stopped once again. At this station, the folder blank 13 is folded along the creasing lines 6–9 by folding means including a fixed die 17 and an upwardly-downwardly movable punch 18. The die 17 is provided with an elongated recess 17*a,* the width of which slightly exceeds the distance between the creasing lines 6 and 7, and the height of which slightly exceeds the distance between the creasing lines 6 and 8, and 7 and 9, respectively. The side walls of the recess 17*a* are preferably parallel but may deviate somewhat from this orientation. When the punch 18 is pressed downwards towards the folder blank 13 resting on the die 17, the lower portion of the punch, which fits into the recess 17*a,* will urge the central portion of the folder blank delimited by the outer creasing lines 8 and 9 thereon into the recess 17*a* in order to define a U-shaped channel in the folder blank, while the portion of the punch which is not immediately above the recess will press the portions of the folder blank located outside the creasing lines 8 and 9 towards the die 17.

Figure 6:
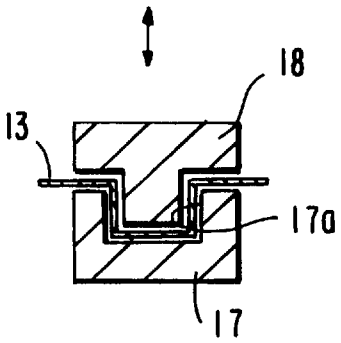
Figure 7:
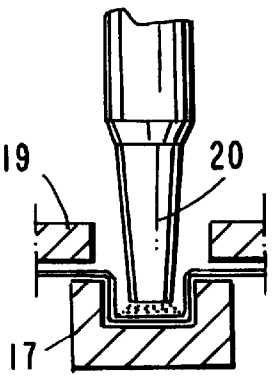

On reactivation of the conveyor 10, the folder blank 13 will be transported to the station D (=FIG. 7), the shape of the folder blank remaining essentially the same as shown in FIG. 6. The folder blank 13 will keep this shape by the die 17 also extending into the station D and by an abutment 19, which presses the cover sheets 2 and 3 in the direction of the die 17, extending from the end of the station C up to and including the end of the station D. At the station D liquid hot-melt glue is sprayed into the U-shaped channel of the folder blank 13 by means of a nozzle 20, the lower end of which is inserted into the channel and is situated at a short distance from the spine of the folder blank. Injection of glue is suitably carried out from a fixed nozzle while the folder blank 13 is transported by the conveyor but, alternatively, may be carried out with the folder blankstanding still at the station D while the nozzle is displaced in the longitudinal direction of the conveyor 10.

Figure 8:
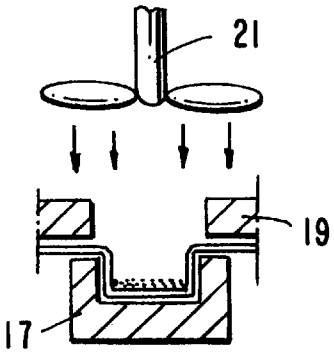

After application of the glue, the folder blank 13 is transported to the station E (=FIG. 8) with the U-shaped channel of the blank still being guided by the die 17, which also extends from the station D up to and including the station E, and possibly with the cover sheets 2 and 3 still outside the creasing lines 8 and 9 pressed down by the abutment 19, which in that case will also extend into the station E. At the station E, the strip of glue deposited on the folder blank will be cooled, for example, by a fan 21 blowing cooling air into the U-shaped channel of the folder blank. Cooling may take place when the conveyor 10 is moving or when it is standing still. On completion of the cooling, the glue in said channel will have solidified and adhered to the spine of the folder blank as well as to the areas of the cover sheets 2 and 3 which are located next to the spine.

Figure 9:
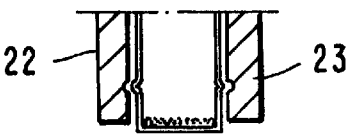
Figure 10:
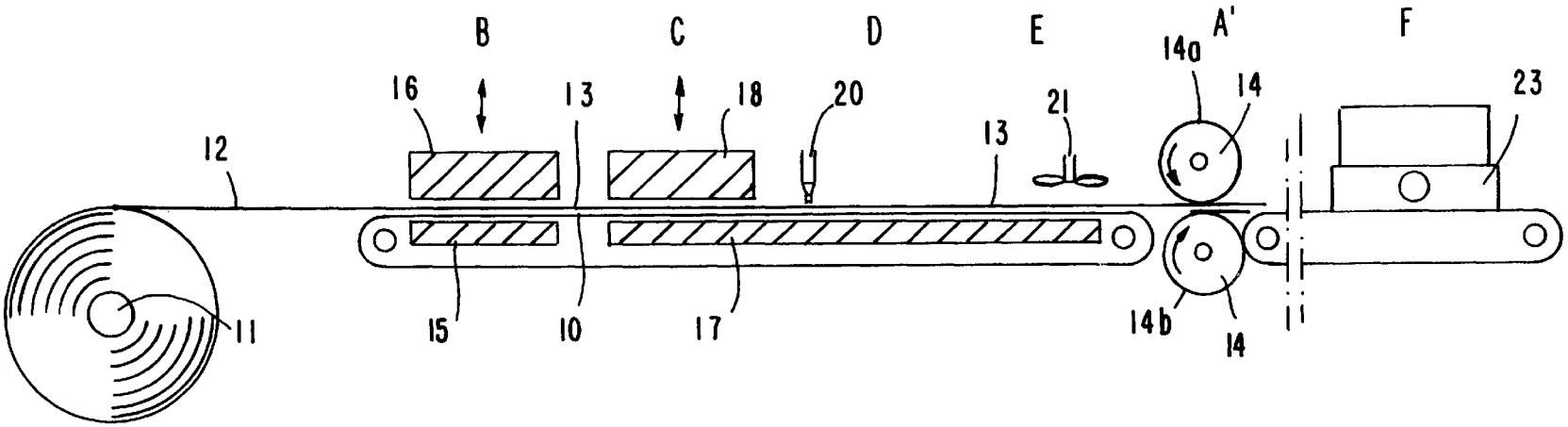
FIG. 10 is a side view, partly in section, of another embodiment of the inventive apparatus for manufacturing folders.

After cooling, the folder blank is transported to the station F (=FIG. 9) where its cover sheets are pressed upwardly-inwardly by two jaws 22 and 23 which are movable towards and away from each other such that the cover sheets 2 and 3 will be essentially parallel to each other. Movement of the jaws 22, 23 may take place during movement of the conveyor 10 or during standstill of the same.

The finished folder 1 will finally be removed from the conveyor 10 in some suitable, non-illustrated way.

The apparatus described above and shown in the drawings may be modified in various ways. Thus, although the quality of the folder will be lowered, station B may be omitted, and creasing may be carried out by means of the punch 18 at the station C while the punch is carrying out the folding. Further, the abutment 19 may be omitted and an elongated nozzle for application of the glue may be inserted between essentially parallel or slightly diverging cover sheets 2, 3. If the cover sheets 2, 3 are further kept in these positions, cooling of the strip of glue will be less effective but, on the other hand, the jaws 22, 23 will probably not be required.

Another modification conceivable is to place the cutting station A after the glue application station D or the cooling station E which, however, may imply that the adherence of the strip of glue to the folder blank will be impaired at the cutting, that the configuration of the cutting device must be made more sophisticated and/or that the external dimensions of the finished folders will vary.

Although only one embodiment of the invention and some modifications of the same have been shown in the drawings and described above, it will be appreciated that the invention is not limited to said embodiment but will only be limited by what is stated in the claims.

What is claimed is:

1. A method for producing folders of the kind including two cover sheets, a spine with a first log connected in a perpendicular orientation to a central connector through a first fold line and a second leg connected in a perpendicular orientation to the central connector through a second fold line, creasing lines connecting the first and second legs of the spine with the cover sheets, and a binding agent which is applied to an inner side of the spine and which is activable to connect sheets inserted between the cover sheets to the spine, comprising the following steps:

folding a folder blank such that at least two parts thereof which are to define the first and second legs of the spine in the folder will be essentially parallel to each other and to a first plane and perpendicular to a second plane formed by the central connector of the spine; and applying the binding agent to the spine on at least the central connector, the first and second fold lines, and the first and second legs while the first and second legs are kept essentially parallel to each other and to the first plane and perpendicular to the second plane formed by the central connector of the spine.

2. The method according to claim 1, further comprising the following additional step:

cooling the binding agent after its application to the spine, and wherein the binding agent is hot-melt glue.

3. The method according to claim 1, wherein the steps are carried out while the folder blank is being held on a conveyor.

4. The method according to claim 1, further comprising the following additional step:

providing the folder blank with the creasing lines before folding of the folder blank.

5. The method according to claim 1, further comprising the following additional step:

providing the folder blank with the creasing lines during folding of the folder blank.

6. The method according to claim 1, further comprising the following additional step:

cutting off the folder blank from a web of material before folding of the folder blank and before application of the binding agent.

7. The method according to claim 1, further comprising the following additional step:

cutting off the folder blank from a web of material after folding of the folder blank and after application of the binding agent.

8. The method according to claim 1, wherein the binding agent is applied with two portions of the cover sheets farthest away from the spine being parallel, each of said two portions of the cover sheets farthest away from the spine being located substantially adjacent to each other.

9. The method according to claim 1, wherein the binding agent is applied with two portions of the cover sheets farthest away from the spine being folded away from each other, each of said two portions of the cover sheets farthest away from the spine forming an angle of substantially 180° with each other and being in the same plane.

10. An apparatus for producing folders of the kind including two cover sheets, a spine with a first leg connected in a perpendicular orientation to a central connector through a first fold line and a second leg connected in a perpendicular orientation to the central connector through a second fold line, creasing lines connecting the first leg and the second leg of the spine with the cover sheets, and a binding agent, which is applied to an inner side of the spine and is activable to connect sheets inserted between the cover sheets to the spine, comprising;

means for folding a folder blank which is not provided with binding agent such that at least two parts thereof which are to define the first and second legs of the spine in the folder will be essentially parallel to each other and to a first plane and perpendicular to a second plane formed by the central connector of the spine; and means disposed above the inner side of the spine for applying hot-melt binding agent to the spine on at least the central connector, the first and second fold lines, and the first and second legs while the first and second legs are kept essentially parallel to each other and to the first plane and perpendicular to the second plane formed by the central connector of the spine.

11. The apparatus according to claim 10, further comprising:

a conveyor to which ready-cut folder blanks are delivered; and means disposed serially along the conveyor for creasing and folding of each folder blank and for application of binding agent to the same.

12. The apparatus according to claim 10, wherein the means for applying include a spraying nozzle for hot-melt glue, said spraying nozzle having a spray opening which is smaller than a width of the spine.

13. The apparatus according to claim 10, further comprising means for creasing the folder blank before folding of the folder blank.

14. The apparatus according to claim 10, further comprising means for creasing the folder blank during folding of the folder blank.

15. The apparatus according to claim 10, further comprising means for cutting off the folder blank from a web of material before folding of the folder blank and before application of the binding agent.

16. The apparatus according to claim 10, further comprising means for cutting off the folder blank from a web of material after folding of the folder blank and after application of the binding agent.

* * * * *